United States Patent [19]

Shumway

[11] 4,297,542

[45] Oct. 27, 1981

[54] FOLDED CIRCUIT SWITCH APPARATUS HAVING MULTIPLE CONTACTS

[76] Inventor: Anthony G. Shumway, 734 W. 6th Ave., Mesa, Ariz. 85202

[21] Appl. No.: 105,261

[22] Filed: Dec. 19, 1979

[51] Int. Cl.[3] ..... H01H 19/70; H01H 25/04

[52] U.S. Cl. ..... 200/6 A; 200/5 R; 200/5 A

[58] Field of Search ..... 200/5 A, 6 A, 159 B, 200/292, 5 R

[56] References Cited

U.S. PATENT DOCUMENTS

| | | | |
|---|---|---|---|
| 3,909,564 | 9/1975 | Scheingold et al. | 200/5 A X |
| 3,911,234 | 10/1975 | Kotaka | 200/5 A |
| 4,007,364 | 2/1977 | Ojima et al. | 200/5 A X |
| 4,028,509 | 6/1977 | Zurcher | 200/5 A |
| 4,029,915 | 6/1977 | Ojima | 200/5 A |
| 4,124,787 | 11/1978 | Aumoth et al. | 200/6 A |
| 4,180,711 | 12/1979 | Hirata et al. | 200/5 A |
| 4,207,443 | 6/1980 | Matsuura | 200/5 A |
| 4,246,452 | 1/1981 | Chandler | 200/5 A |

OTHER PUBLICATIONS

IMB Tech. Disc. Bull., H. L. Funk et al., "Keyboard Encoder, " vol. 7, No. 11, Apr. 1965, pp. 1018, 1019.

*Primary Examiner*—James R. Scott

*Attorney, Agent, or Firm*—H. Gordon Shields

[57] ABSTRACT

Folded circuit switch apparatus includes multiple contacts responsive to a single switch capable of making contacts selectively with one or two switch elements at any particular time.

6 Claims, 5 Drawing Figures

FIG. 1
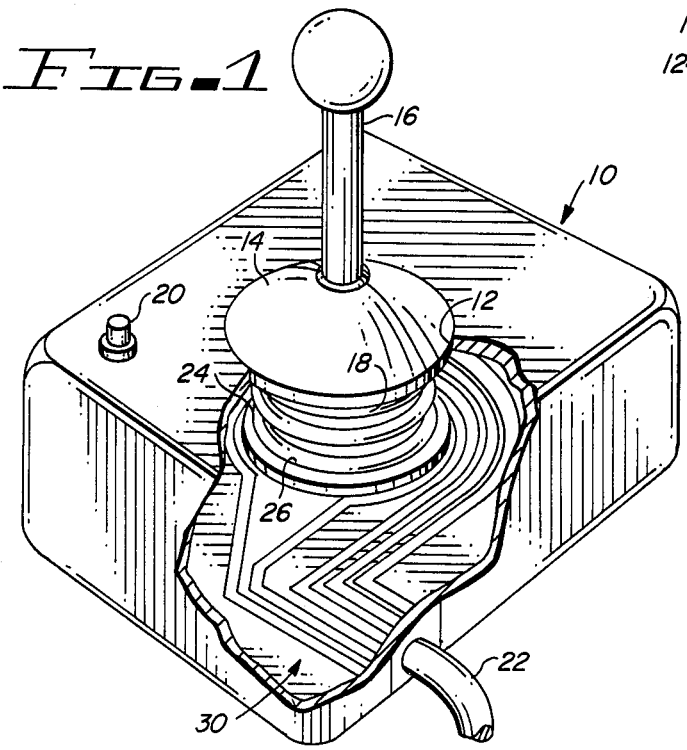
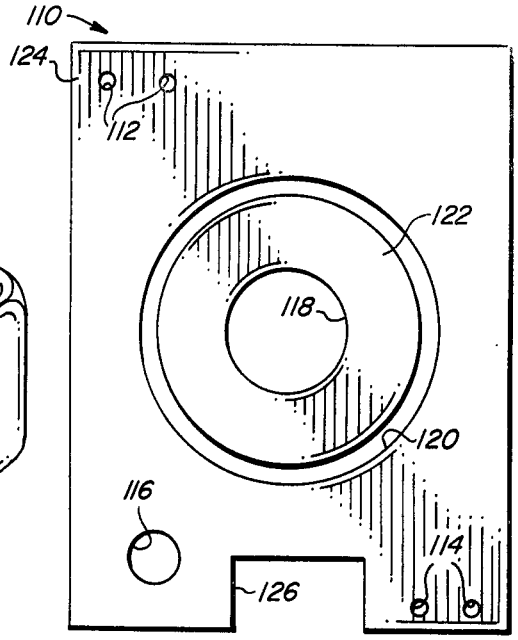
FIG. 3
FIG. 2
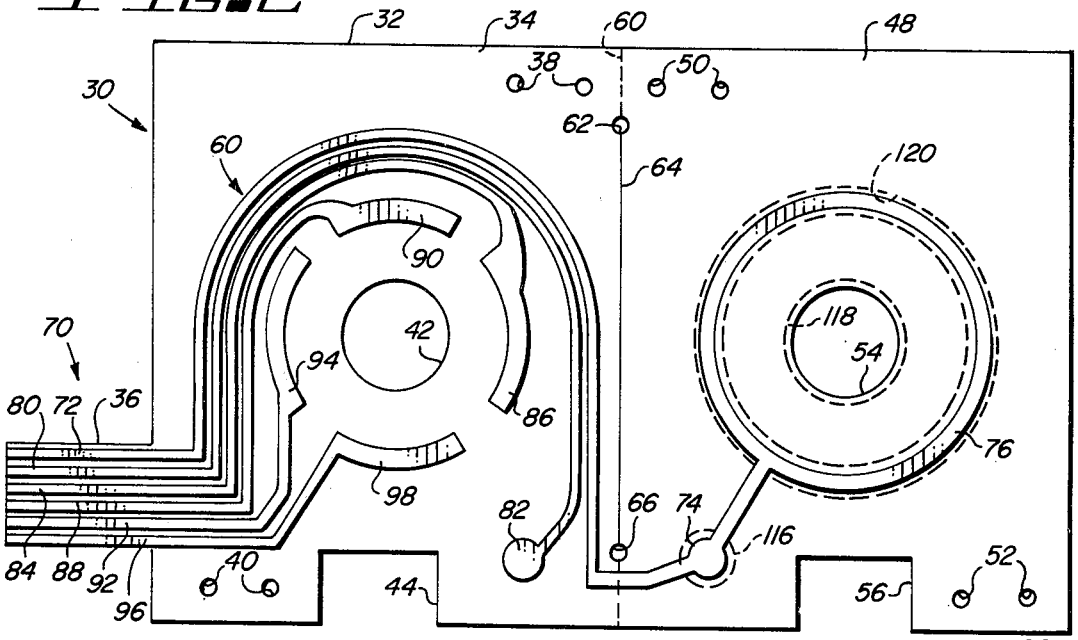
FIG. 5
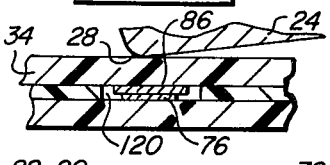
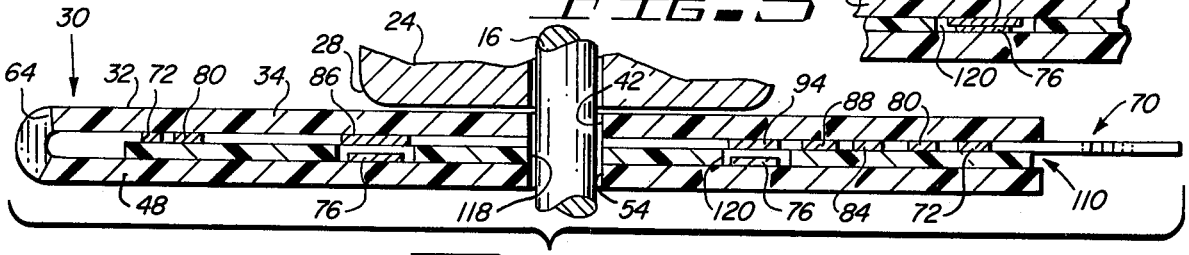
FIG. 4

FOLDED CIRCUIT SWITCH APPARATUS HAVING MULTIPLE CONTACTS

BACKGROUND OF THE INVENTION

1. Field of the Invention

This invention relates to switch apparatus and, more particularly, to switch apparatus utilizing folded circuitry for providing an inexpensive and reliable switch apparatus.

2. Description of the Prior Art

U.S. Pat. No. 3,383,487 is an early example of a switch being formed of two layers of relatively thin, flexible material, with portions of each layer of material having electrically conductive material disposed thereon. When the two layers of material are placed together, a bubble is formed in the area of the conductive materials to provide an inherent bias to prevent the contact between the conductive elements until a positive pressure or bias is applied to the bubble. When the pressure is released, the bubble returns to its original configuration, with the conductive elements spaced apart.

U.S. Pat. No. 3,789,167 discloses a circuit board in which a pattern of conductive material is disposed on the board and a resilient conductive layer is placed on top of the circuit board, with a layer of insulation between the two conductive elements. A plurality of windows or apertures extend through the insulator for allowing electrical contact between the conductors when positive pressure is applied. Pins are also used to hold the conductive layers apart. Such apparatus is utilized primarily in keyboard type applications, in which a single conductive layer may make selective contact with keyboard elements to provide output signals representing the elements of the keyboard.

U.S. Pat. No. 3,860,771 discloses a similar keyboard type circuit apparatus in which the keyboard elements include a snappable plastic dome to provide a positive tactile response by the user.

The general concept of the folded type circuit is typically used for keyboard applications, as discussed above. Individual switches are identified by their individual output signals generated from electrical contact with a common conductive layer. The conductive elements, including the conductive layer and the switch elements, are spaced apart by a layer of insulation. Some type of bias is applied to each discrete switch element to provide a bubble effect which serves two purposes. The one purpose is, of course, to maintain the switch elements apart to prevent unwanted electrical contact, and the second purpose is to provide a positive actuation of a switch upon a single desired movement by a user.

The folded type circuit of the present invention responds to movement of a switching element held by a user and accordingly differs from the keyboard type apparatus which is typical of the prior art.

SUMMARY OF THE INVENTION

The invention described and claimed herein comprises a folded circuit type element in which a pair of conductive circuits are disposed on a single layer of insulative material and the insulative material is folded together to appropriately mate the two conductive patterns. An insulative layer is disposed between the two conductive patterns with appropriate spaces or gaps to allow electrical contact between the patterns as desired by a user through the intermediary of a switching element.

Among the objects of the present invention are the following:

To provide new and useful switching apparatus;

To provide new and useful folded circuit switching apparatus;

To provide new and useful folded circuit apparatus;

To provide new and useful switch apparatus utilizing a switching element to provide electrical contact between two conductive elements;

To provide new and useful electrical switch apparatus;

To provide new and useful folded circuit apparatus utilizing a non-conductive spacer between two insulative layers with switching elements disposed on the two layers;

To provide new and useful electrical switching apparatus making electrical contact selectively between two or three conductive elements;

To provide new and useful switch apparatus having a single movable element for making contact selectively with one or two out of a plurality of fixed elements; and To provide new and useful electrical switching apparatus having a switch element movable to make selective contact with any one or two adjacent contacts out of a plurality of fixed contacts disposed circumferentially adjacent to the movable contact.

BRIEF DESCRIPTION OF THE DRAWING

FIG. 1 is a perspective view of apparatus employing the switching apparatus of the present invention.

FIG. 2 is a plan view of the circuit apparatus of the present invention prior to folding.

FIG. 3 is a top view of the insulative layer used for the apparatus of the present invention.

FIG. 4 is a sectional view of the switch apparatus of the present invention shown folded in a use position or orientation.

FIG. 5 is a fragmentary sectional view of the switch apparatus of the present invention being activated.

DESCRIPTION OF THE PREFERRED EMBODIMENT

FIG. 1 is a perspective view of an enclosure 10 in which is disposed switch apparatus of the present invention. The enclosure is generally of a rectangular configuration. A portion of the enclosure 10 is broken away in FIG. 1 to show the folded circuit switch apparatus disposed within the enclosure, including switch circuitry 30. FIG. 2 comprises a plan view of switch circuitry 30 in its open, unfolded condition. FIG. 3 is a plan view of an insulator or spacer 110 which fits over a portion of the switch circuitry 30 of FIG. 2. FIG. 4 is a view in partial section through the switch circuitry 30, illustrating the completed switch, with the circuitry 30 folded and with the insulator or spacer layer 110 disposed between the two layers or halves of the switch circuitry 30. FIG. 5 is a fragmentary sectional view illustrating the actuation of the switch apparatus of the present invention. Reference will be made to all five Figures in the following discussion of the switch apparatus.

As shown in FIG. 1, the enclosure 10 is a generally rectangularly configured box with a hollow interior in which is disposed the switch apparatus of the present invention.

An aperture 12 extends through the top of the enclosure. The aperture 12 is preferably centrally disposed with respect to the enclosure 10. The enclosure comprises a control box for apparatus to which the switch apparatus of the present invention is connected, as will be discussed in more detail below. The central aperture 12 provides access to the switch circuitry 30 from the exterior of the enclosure 10.

Extending through the aperture 12 is an upper concave portion of a spring retainer 14. Within the enclosure 10, and disposed on the switch circuitry 30, is a pressure plate 24. The pressure plate 24 includes a circular spring groove in which is disposed one end of a compression spring 18. The compression spring 18 extends from the pressure plate 24 to the upper spring retainer 14. A control stick 16 extends through a central aperture in the spring retainer 14, through the center of the spring 18, and through a central aperture in the pressure plate 24, as best shown in FIG. 4.

The outer diameter of the spring retainer 14 is larger than that of the aperture 12. Accordingly, the spring retainer 14 remains within the enclosure 12, with the upper convex outer surface of the retainer extending upwardly through the aperture 12 in response to movement of the control stick 16. The control stick 16 pivots on a pivot point (not shown) at the bottom of the enclosure 10 to actuate the switch circuitry 30, as discussed below.

The switch circuitry 30 includes a layer of flexible insulative material 110, such as "Mylar," of a predetermined thickness, disposed between a folded insulative layer 32. The insulative layer 32 is preferably made of the same material as is the insulative layer 110. The insulative layer 32 is divided into two halves, including a first half 34 and a second half 48, best shown in FIG. 5 in plan view. The two halves are divided by a center line 60, which comprises a fold line for the switch circuitry 30. The center line 60 includes two spaced apart apertures 62 and 66, with a cut 64 extending between the apertures 62 and 66. The apertures 62 and 66 and the cut 64 aid in folding the layer 32 to complete the switch circuitry.

Because the alignment of the two halves 34 and 48 and the alignment of the insulative or spacer layer 110 is of substantial importance, indexing holes are included. The half 34 includes a pair of holes 38 adjacent the center or fold line 60, and a pair of holes 40 remote from the center line 60. The second half 48 includes a pair of holes 50 adjacent the fold line 60 and a second pair of holes 62 remote from the center or fold line 60. The insulative layer 110 also includes two pair of holes, including a pair 112 disposed adjacent one side edge of the layer 110, and a pair 114 adjacent another side edge of the layer 110. When the insulative layer 110 is placed on the half 48, the holes 112 are aligned with the holes 50, and the holes 114 are aligned with the holes 52. When the two halves 34 and 48 are folded together, the holes 58 and 38 are aligned with each other and the holes 52 and 40 are aligned with each other in order to appropriately orient the two halves together.

One hole of each pair is an alignment or indexing hole, and the other hole of each pair is for receiving a bolt, screw, or other fastener for assembling the apparatus. When the two halves 34 and 48 are folded, with the insulator 110 between the two halves, as illustrated in FIG. 4, the pairs of holes in the halves and in the insulator layer appropriately mate with each other for alignment purposes. By using alignment pins in one of each pair of holes, the three discrete layers (that is, the two halves and the insulator) are appropriately and accurately aligned for assembly. The alignment is maintained by two factors, the use of mechanical fasteners in the second of each pair of holes, such as a screw, and the use of an adhesive on both sides of the insulator 110 to insure that the three layers remain together in alignment.

The half 34 includes a connector tab 36 which extends outwardly from the main body portion of the layer 32. The purpose of the connector tab 36 is to allow conductive segments of the switch circuitry 30 to be appropriately connected to other conductors, as will be discussed below.

Six conductors are shown disposed on the connector tab 36 and on the first half 34. One of the conductors extends from the first half 34 onto the second half 48 of the insulative layer 32. The six conductors are spaced apart from each other and include geometrically configured segments for switch actuation purposes.

The conductive segments which comprise the active switch elements are disposed symmetrically about a central aperture 42 which extends through the first half 34. A central aperture 54 also extends through the second half 48. The apertures 42 and 54 are aligned with each other, as best shown in FIG. 4, when the layer 32 is folded to its finished configuration, as shown in FIGS. 4 and 5.

The six conductive segments, collectively denoted by reference numeral 70, include a voltage supply segment 72 and a starter or actuation segment 80. The supply segment 72 extends from the connector tab 36 onto the first half 34 and onto the second half 48. The supply segment terminates in a conductive ring 76 on the second half 48. The ring 76 is disposed concentrically about the central aperture 54. A pad 74 in the supply segment 72 is disposed on the second half 48 spaced apart from the ring 76.

The start or actuation segment 80 comprises a conductive segment which extends from the connector tab 36 generally parallel to the supply segment 72, but spaced apart therefrom, on the first half 34. The start conductor 80 terminates in a pad 82. The pad 82 and the pad 74 are disposed equally distant apart from the center line 60 so as to be in registration or alignment with each other when the halves 34 and 48 are folded together.

The remaining four conductive segments comprise control segments for providing output signals from the switch apparatus of the present invention. They include control segments 84, 88, 92, and 96. The control segment 84 extends from the connector tab 36 to the first half 34. The control segment 84 terminates in an arcuate switch pad 86 disposed concentrically about the aperture 42. The second control segment 88 extends from the connector tab 36 to an arcuate switch pad 90. The third control segment 92 extends from the connector tab 36 to an arcuate switch pad 94. The fourth control segment 96 extends from the connector tab 36 to an arcuate switch pad 98, also on the first half 34.

The control segments or conductors 84, 88, 92, and 96 are spaced apart from each other and also from the conductive segments 72 and 80. The arcuate switch pads 86, 90, 94 and 98 are spaced apart from each other and are disposed symmetrically about the aperture 42 on the first half 34. They each extend for arcuate distances about the aperture 42, which arcuate distances are substantially the same for each conductive segment.

This is best shown in FIG. 5. The arcuate switch pads comprise discrete segments of a ring or circle, and which are electrically spaced apart or isolated from each other. Each of the segments is substantially the same radial distance away from the center of the aperture 42. When the two halves 34 and 48 are folded together, the switch pads 86, 90, 94, and 98 are aligned with the ring 76 on the half 48. This is shown in FIG. 4, which shows the alignment of the ring 76 with the arcuate segments 86 and 94.

The insulator 110, as best shown in FIG. 3, includes a plurality of openings which allow electrical contact between the conductors on the two halves. Included as one of the openings is an aperture 116 which is aligned or is in registration with the pads 74 and 82 of the layer 32 when the insulator 110 is assembled to the layer 32 and with the layers folded together, as shown in FIGS. 4 and 5. The aperture 116 is shown in phantom in FIG. 5. The purpose of the aperture 116 is to allow electrical contact between the pad 82 and the pad 74 to actuate the game apparatus to which the switch apparatus of the present apparatus is connected.

A start button 20 is shown extending upwardly from the enclosure 10 in FIG. 1. The start button 20 comprises simply a spring biased rod disposed above the pads 82 and 74. Positive downward pressure on the button or switch 20 causes the pads 82 and 74 to make electrical contact, thereby transmitting an electrical signal from the pad 82 and the conductor 80 to the particular game or apparatus to which the switch apparatus of the present invention is connected. The aperture 116 allows such electrical contact upon the depression of the switch 20 against the bias of a spring (not shown). Such switch actuators are well known and understood in the art.

The insulator layer 110 includes another opening defining a central aperture 118. The aperture 118 is coaxially aligned with the central apertures 42 and 54 of the halves 34 and 48, respectively, when the three layers are aligned, as shown in FIG. 4.

Concentrically outwardly from the central aperture 118 is a third opening defining a ring aperture 120. The ring aperture 120 coincides with the conductive ring 76 and with the conductive segments 86, 90, 94, and 98 of the two halves 48 and 34, respectively. The central aperture 11 and the ring aperture 120 are outlined in phantom in FIG. 2.

Between the central aperture 118 and the ring aperture 120 is an inner insulative ring layer 122. The portion of the insulative layer 110 outwardly from the ring aperture 120 may broadly be referred to as an outer insulative layer 124. The layer 124, when the insulator 110 is disposed between the halves 34 and 48, covers the conductive segments 70 and accordingly allows electrical contact only between the pads 82 and 74 through the aperture 116. Together, the layer 124 and the ring layer 122 allow electrical contact between the conductive ring 76 and the conductive segments 86, 90, 94, and 98 through the ring aperture 120.

For assembly purposes, the insulator 110 is preferably coated with an adhesive on both sides. This allows the insulator 110 to be fixed in place between the layers 34 and 48, and secured to both the layers to prevent any misalignment relative to the layer 110 and to the halves 34 and 48 of the layer 32.

With the layer 32 in the open, unfolded position, as shown in FIG. 2, the various conductive segments may be screen printed onto the layer 32 using a conductive ink. When the ink dries, the conductive segments remain on the layer 32. The conductive segments may then be appropriately secured to a six conductor cable, such as a cable 22 illustratively shown in FIG. 1 as extending out of one side of the enclosure 10. The connection between the conductive segments 70 and the conductors within the cable 22 are made at the connector tab 36 of the layer 32.

Actuation of the switch apparatus of the present invention is accomplished by the pressure plate 24, as illustrated in FIGS. 4 and 5. The pressure plate 24 includes an outer periphery 28 which is disposed adjacent the conductive ring 76 and the conductive arcuate switch pad segments 86, 90, 94, and 98. The diameter of the pressure plate 24 is accordingly dimensioned so as to conform to the diameter of the conductive ring 76 and the arcuate switch pads associated therewith.

The spring 18 provides a bias between the pressure plate 24 and the retainer 14. Since the distance between the retainer and the pressure plate is generally fixed, the spring also acts as a biasing element to center the pressure plate 24, as shown in FIG. 4.

Movement of the control stick 16, which is a pivoting movement, causes the pressure plate 24 to move or pivot since the pressure plate 24 is disposed coaxially with respect to the control stick 16. The selective movement of the control stick accordingly causes the pressure plate to contact the upper half 34 of the switch circuitry 30 in the general area of the four arcuate switch pads or segments, as shown in FIG. 5. When the outer periphery 28 contacts the insulator layer 34, the insulator layer 34 deflects to cause electrical contact between the ring 76 and one or two of the switch pads, depending on where the control stick 18 is moved. FIG. 5 illustrates contact between the arcuate switch segment 86 and the conductive ring 76.

The relative thickness of the insulator layers 32 and 110 are substantially the same, and are relatively thin, such as on the order of five mils. The adhesive layers are about two mils in thickness each, for a total thickness of the spacer of about nine mils. The thickness of the conductive segments is about five mils. The relative thicknesses require the layer 34 to flex only a very slight amount in order to provide electrical contact between the conductive segments in response to control stick pressure or movement. The inherent flexibility of the conductive layer 32 is such that the flexing may be accomplished and, when the pressure or force is removed, the layer will return to its original configuration or orientation, thus breaking the electrical contact.

Referring specifically to FIG. 3, it will be noted that the arcuate conductive switch segments or pads 86, 90, 94, and 98 are disposed in general alignment with the rectangular sides of the layer 32 and accordingly of the switch 30. The conductive switch segments extend arcuately somewhat less than ninety degrees each, but with the center of each conductive segment or pad aligned generally with what may be referred to as the four cardinal points of a compass, or with the four primary positions of a clock. That is, the conductive segment 90 extends less than ninety degrees total, symmetrically about the twelve o'clock position from about eleven o'clock to about one o'clock. The arcuate segment 86 also extends somewhat less than ninety degrees symmetriclly about the three o'clock position, from about two o'clock to about four o'clock. The switch segment 98 extends arcuately somewhat less than ninety degrees symmetrically about the six o'clock position, between about five o'clock and about seven o'clock. The segment 94 also extends arcuately somewhat less than ninety degrees symmetrically about the nine o'clock position, between about eight o'clock and about ten o'clock. Since the segments 86, 90, 94, and 98 are disposed adjacent the continuous ring 76, only a slight deflection of the half layer 34 is required to make contact between any one of the segments, or between two of the segments, and the conductive ring 76 to provide an output signal on any of the respective control segments which extend to the arcuate switch segments.

Referring to FIG. 2, but also referring to FIGS. 4 and 5, it will be seen that if the control stick 16 (see FIG. 1) were superimposed on the first half 34 of the conductive layer 32 and within the central aperture 42, pivoting the control stick 16 forwardly, or in the twelve o'clock position, it would cause the outer periphery 28 of the pressure plate 24 to deflect the conductive layer 34, with its conductive segment 90, downwardly. Similarly, movement of the control stick 16 in the three o'clock position, the six o'clock position, or the nine o'clock position would result in movement or deflection of the switch segments 86, 98, or 94, respectively. Such deflection of the control segment would result in contact wit the segment 76 which would in turn result in an output signal from the switch apparatus.

Movement of the control stick 16 in a forty-five degree direction, or about the one-thirty o'clock position, would result in deflection of portions of segments 94 and 90, resulting in turn in selective contact of both the segments 94 and 90 with the ring 76. Accordingly, an output signal would be transmitted on both segments 92 and 88, which are respectively connected to the segments 94 and 90. A similar, selective forty-five degree direction of movement of the control stick 16 between the four cardinal positions or directions would also result in contact with the ring 76 by two of the switch segments, resulting in two output signals.

Thus, it may be understood that appropriate movement of the control stick 16 may selectively result in a single signal or in two signals at any one time. However, at any one time a maximum of only two conductive switch segments may make contact with the ring segment 76. For control purposes, one or two output signals from the conductive segments 70 may be appropriately interpreted as a directional indication for a game with which the apparatus of the present invention is used.

A typical application of the switch apparatus of the present invention is for the remote directional control of a game piece, gun, or the like. A projectile or the like may be directed to move in any of eight general directions by the appropriate movement of the control stick 16. Such projectile or game piece may then be moved in virtually any direction by sequential instructions to appropriate movements of the stick 16 to cause an output signal generated by the electrical contact of the switch segments and the ring 76.

In the embodiment discussed above and illustrated in the drawing, four conductive switch segments are used to provide a total of eight output or control signals. If the number of segments is increased, the number of output signals is appropriately increased to correspond to twice the number of switch segments used since each switch segment can produce a single output and a second output is obtained by simultaneous contact with any two adjacent switch segments.

Each switch segment comprises a single switch contact. The switch apparatus 30 is capable of providing an output signal from any one of the switch contacts or from any adjacent pair of switch contacts. A joint output signal from a pair of contacts comprises a separate signal from two sequential but discrete single output signals from the same pair of contacts, thus increasing the flexibility of the apparatus.

It is understood that whichever layer 34 or 48 is fixed in position and whichever layer flexes for switch contact is immaterial.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention.

What is claimed is:

1. Switch apparatus for providing a plurality of output signals, comprising, in combination:

a first flexible insulative layer;

first conductive means disposed on the first flexible insulative layer including a plurality of arcuate conductive segments disposed symmetrically on the first flexible insulative layer;

a second insulative layer;

a second conductive means disposed on the second insulative layer and including a circular conductive segment disposed adjacent the plurality of arcuate conductive segments of the first conductive means;

a third insulative layer disposed between the first and second insulative layers;

opening means in the third insulative layer to allow electrical contact selectively between one conductive segment or with two adjacent conductive segments, of the first conductive means and the circular conductive segment of the second conductive means; and switch actuation means to provide flexing of the first flexible insulative layer to cause electrical contact between the first and second conductive means through the opening means.

2. The apparatus of claim 1 in which the switch actuation means includes a pressure plate disposed adjacent the first flexible insulative layer and movable to flex the first flexible insulative layer to provide electrical contact between the second conductive means and at least one segment of the first conductive means.

3. The apparatus of claim 1 in which the switch actuation means includes a pressure plate selectively movable to provide electrical contact between the second conductive means and either one segment of the first conductive means or two adjacent conductive segments of the first conductive means.

4. The apparatus of claim 1 in which the switch actuation means includes a pressure plate disposed adjacent the plurality of conductive segments of the first conductive means and a control stick pivotable to selectively cause the pressure plate to contact the first flexible insulative layer to cause the first flexible insulative layer to flex to provide contact between the first conductive means disposed on the first flexible insulative layer and the second conductive means disposed on the second insulative layer through the opening means.

5. The apparatus of claim 1 in which the opening means includes a ring aperture extending through the third layer adjacent the plurality of arcuate conductive segments and the circular conductive segment through which the circular conductive segment makes contact selectively with one conductive segment or with two adjacent conductive segments of the first conductive means.

6. The apparatus of claim 5 in which the switch actuation means includes a switch actuator disposed adjacent the first conductive means and movable to flex the first flexible insulative layer and the first conductive means through the ring opening to provide electrical contact between the first and second conductive means.

* * * * *